US008281633B2

(12) United States Patent
McKenney et al.

(10) Patent No.: US 8,281,633 B2
(45) Date of Patent: Oct. 9, 2012

(54) ACTIVE TRANSFER APPARATUS FOR HOT STRIP MILL COILBOX

(75) Inventors: Carl McKenney, Caledonia (CA); Martin Murray, Toronto (CA); Maurizio Darini, Toronto (CA); Dino Rubli, Millgrove (CA)

(73) Assignee: Hatch Ltd., Mississauga (CA)

( * ) Notice: Subject to any disclaimer, the term of this patent is extended or adjusted under 35 U.S.C. 154(b) by 1176 days.

(21) Appl. No.: 12/035,211

(22) Filed: Feb. 21, 2008

(65) Prior Publication Data

US 2009/0211324 A1 Aug. 27, 2009

(51) Int. Cl.
*B21B 39/20* (2006.01)
*B65H 67/00* (2006.01)

(52) U.S. Cl. ..... 72/250; 242/533.2

(58) Field of Classification Search ..... 72/142, 72/146, 148, 168, 169–173, 183, 227, 231, 72/250, 426, 428; 242/533.2, 533.3, 533.7, 242/535.1, 559
See application file for complete search history.

(56) References Cited

U.S. PATENT DOCUMENTS

| | | | |
|---|---|---|---|
| 3,805,570 | A | 4/1974 | Smith |
| 4,005,830 | A | 2/1977 | Smith |
| 4,019,359 | A | 4/1977 | Smith |
| 4,297,865 | A | 11/1981 | Smith |
| 4,306,438 | A | 12/1981 | Child et al. |
| 4,842,209 | A | 6/1989 | Saukkonen |
| 5,310,131 | A | 5/1994 | Monaco et al. |
| 5,361,618 | A | 11/1994 | Stefanelli |
| 5,938,144 | A | 8/1999 | Kaipf et al. |
| 5,987,955 | A | 11/1999 | Benner |

FOREIGN PATENT DOCUMENTS

| | | |
|---|---|---|
| CN | 2732376 Y | 10/2005 |
| JP | 10-034231 | 2/1998 |
| WO | PCT/EP2004/008078 | 3/2005 |

OTHER PUBLICATIONS

English translation of the abstract of Japanese patent publication No. JP 10-034231.
English translation of the abstract of Chinese patent publication No. CN 2732376.

*Primary Examiner* — Debra Sullivan
(74) *Attorney, Agent, or Firm* — Bereskin & Parr LLP

(57) ABSTRACT

An apparatus for actively transferring a coil of hot metal within a coilbox in hot strip mill. The apparatus is located downstream of the initial coilbox uncoiling station and includes at least one singly pivoting coil cradle. Such a coil cradle has a first support roller with a fixed rotational axis, a swing-frame mounted to pivot about that axis, and a second support roller mounted to the swing-frame, able to pivot about the fixed rotational axis of the first support roller to permit the coil of hot metal to be passed from the coil cradle. In certain embodiments, the apparatus includes a plurality of such singly pivoting coil cradles. The apparatus may also include at least one dually pivoting coil cradle.

6 Claims, 4 Drawing Sheets

ACTIVE TRANSFER APPARATUS FOR HOT STRIP MILL COILBOX

TECHNICAL FIELD

This invention relates to an apparatus for manipulating a coil of metallic material in a hot strip mill production line. In particular, it relates to an apparatus for actively transferring a coil of hot metal within a coilbox, downstream of the initial uncoiling station.

BACKGROUND

A coilbox provides an intermediate process in a hot strip mill in which a hot metal transfer bar is coiled at high speed from the roughing mill and then uncoiled at slow speed into the finishing mill. The head of the transfer bar enters the coilbox and is directed into the coiling area, where bending rollers drive and impart downward curvature, forming first the coil eye and then assisting additional coil wraps to be formed about the eye. A coil forming roller and a pair of driven cradle rollers support and contain the growing coil.

Uncoiling starts when the cradle rollers reverse coil rotation and a peeler forces open the outermost coil wrap, so as to feed the new head into a crop shear entry area and then toward the finishing mill. Uncoiling may involve active and/or passive coil transfer from the coiling area, through an intermediate uncoiling and transfer area, into a final uncoiling area.

The coilbox has revolutionized hot strip mill production of steel because it saves heat by accumulating long transfer bars between the roughing mill and the finishing mill. The coiling process reduces the surface area available for heat to radiate from the bar. This results in the uncoiled bar having virtually the same temperature as when it was coiled, allowing for near isothermal rolling without increasing the required rolling power. Also, the coiled bar is compact compared to the flat bar, which can save space and/or increase capacity of the mill. In addition to these primary benefits, the coilbox also provides further value by: equalizing cold skid-marks from walking beam furnace arrangements; breaking scale; allowing for the insertion of reheated coils; and acting as a temporary holding position before the finishing mill.

U.S. Pat. No. 5,310,131 describes initiating uncoiling of a coiled transfer bar at a first position with subsequent active transfer toward a second and final position without mandrels, using a system of coil cradles of two support rollers that are raised and lowered in opposition by pivoting the cradles, or a system of support rollers and a transfer ramp that are independently raised or lowered by pivoting of their respective frames. Both of these transfer mechanisms are complex, and therefore costly to build and to maintain.

U.S. Pat. No. 5,987,955 discloses an apparatus for active coil transfer from the coiling station to the uncoiling station without a mandrel, where two support rollers form a coil cradle to constitute the coiling station and two other support rollers form a coil cradle to constitute the uncoiling station. The coiling station rollers, and possibly the uncoiling station rollers, are differentially raised and lowered while remaining at a fixed distance from each other, so as to initiate the coil transfer into the uncoiling station, which itself has means for translating downstream from primary to secondary uncoiling positions. Because active transfer occurs by way of a bulk horizontal movement of the uncoiling station, there are regions of the transfer area where support rollers or aprons are periodically not present near the pass line. As a result, a turned down head or a passively transferring coil could fall into these open regions.

The object of the present invention is to address one or more of the disadvantages associated with known active transfer apparatus for use in hot strip mill coilbox assemblies.

SUMMARY

In accordance with the present invention, an apparatus is provided for actively transferring a coil of hot metal within a coilbox in a hot strip mill, the apparatus being located downstream of the initial coilbox uncoiling station and including at least one singly pivoting coil cradle having a first support roller with a fixed rotational axis, a swing-frame mounted so as to be able to pivot about the axis of the first roller, and a second support roller mounted to the swing-frame parallel to the first support roller and in spaced relationship with it to receive and support the coil of hot metal, with the rotational axis of the second support roller thus able to pivot about the axis of the first support roller such that the coil can be passed from the cradle.

In certain embodiments, the apparatus includes a plurality of such singly pivoting coil cradles. The apparatus may also include at least one dually pivoting coil cradle having a first support roller with a non-stationary rotational axis, a first swing-frame mounted so as to be able to pivot about the axis of the first roller, a second support roller mounted to the first swing-frame with its rotational axis parallel to the axis of the first support roller, a second swing-frame mounted so as to be able to pivot about a grounded axis, the first and second support rollers being in spaced relationship to receive and support a coil of hot metal, and the first support roller being able to revolve about the grounded axis, and the second support roller being able to revolve about the first support roller so that a coil of hot metal supported by the support rollers can be raised and passed over at least one of the support rollers out of the coil cradle.

Embodiments of the invention are described in further detail below, and shown in the accompanying drawings. Those skilled in the art will appreciate that many variations of the described embodiments are possible within the broad scope of the invention as claimed.

BRIEF DESCRIPTION OF THE DRAWINGS

In order that the various inventive embodiments described herein may be better understood, and to show more clearly how these exemplary embodiments may be carried into effect, reference will be made to the accompanying drawings in which.

DETAILED DESCRIPTION

Figure 1:
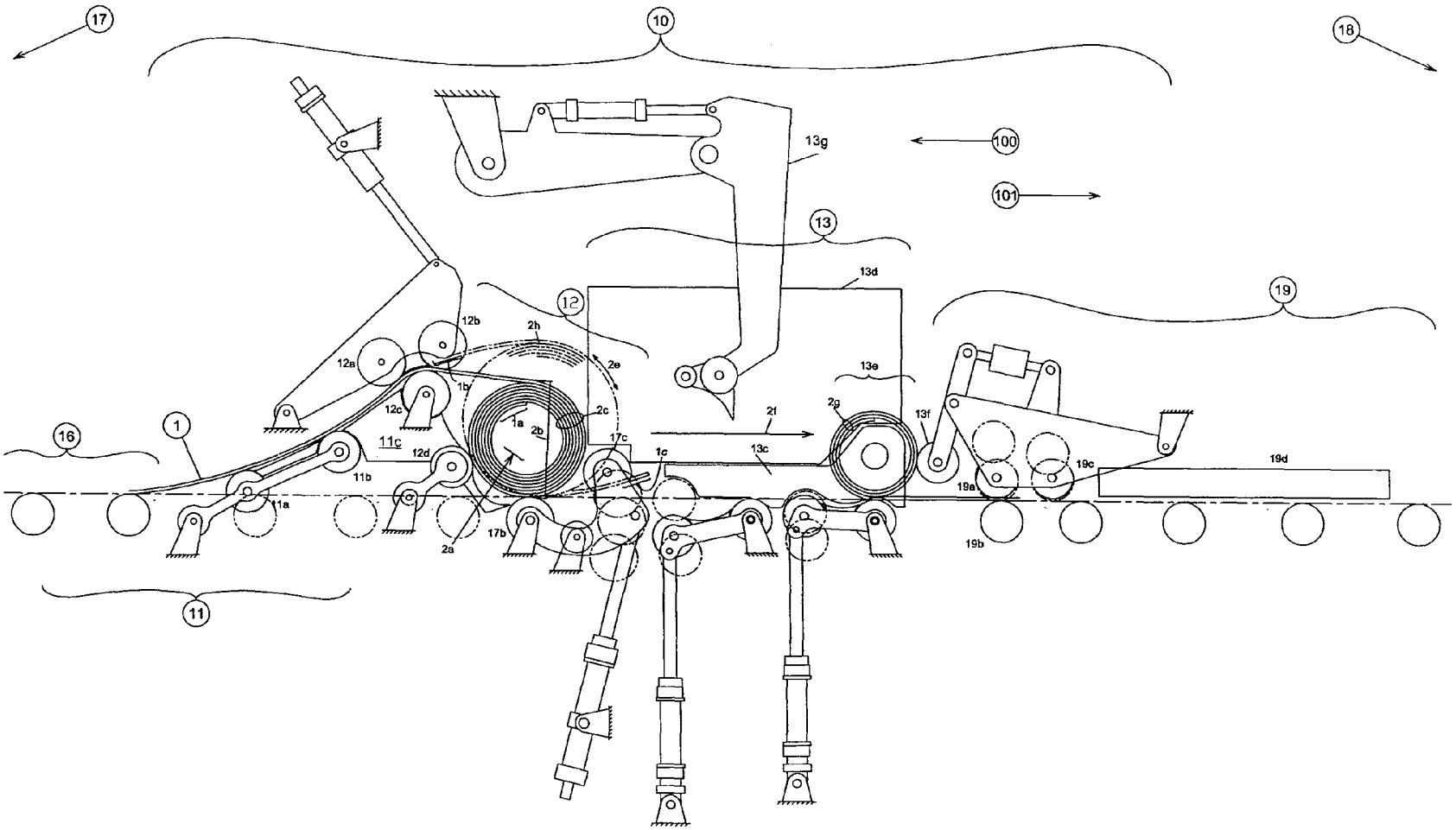
FIG. 1 is a schematic elevation view of a portion of a hot strip mill production line including an active coil transfer apparatus of a coilbox according to a first embodiment.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description of the various examples provided herein is meant to further an understanding of various aspects of the applicant's teachings and should not be construed as limiting the scope of the present teachings in any way. Furthermore, it should be noted that the word "exemplary" is used herein to denote an example of an embodiment of a device or method, and does not necessarily indicate a preferred implementation of the device or method.

Figure 2:
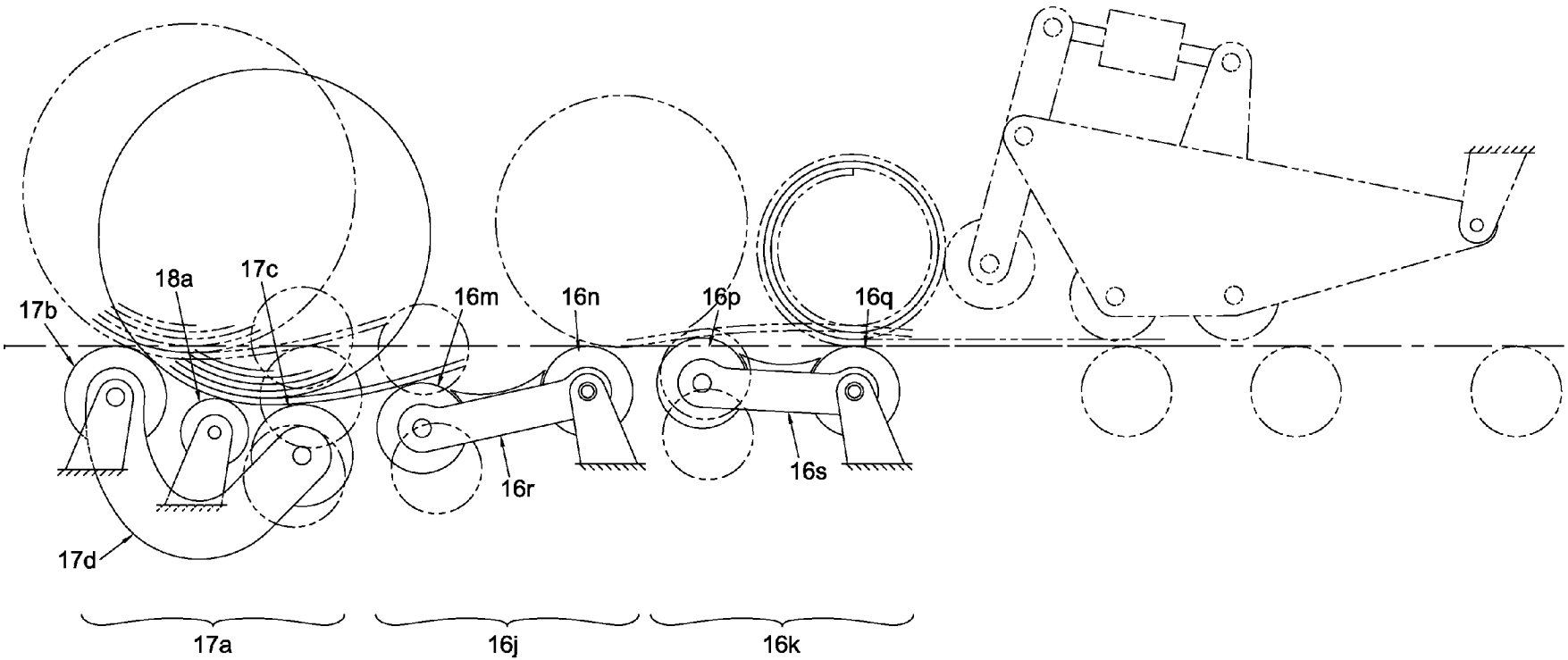
FIG. 2 an enlarged schematic elevation view of the active coil transfer apparatus of the production line of FIG. 1.

As seen in FIGS. 1 and 2, a coilbox (10) in a hot strip mill production line provides an intermediate process in which a hot metal transfer bar (1) is coiled at high speed from the roughing mill (17—not shown) and then uncoiled at slow speed into the finishing mill (18—not shown). The transfer bar (1) is driven by the roughing mill (17) and delay table (16) towards the coilbox entry area (11) where it is centered about the mill axis. The head (1*a*) of the transfer bar enters the coilbox (10) and is directed into the coiling area (12) by driven rollers (11*a,b*) and guiding aprons (11*c*). In the coiling area (12), bending rollers (12*a,b,c*) drive and impart downward curvature to the transfer bar (1), forming first the coil eye (2*a*) and then assisting additional coil wraps (2*c*) to be formed about the eye (2*a*). A coil forming roller (12*d*) and a pair of driven cradle rollers (17*b,c*) support and contain the growing coil. At particular stages of coil formation, the bending rollers (12*a,b*) begin rising and the cradle roller (17*c*) begins lowering to accommodate the increasing coil diameter (2*b*). As the transfer bar tail (1*b*) approaches the coilbox (10), the bending rollers (12*a,b*) are further raised for the tail-stop sequence; as the tail (1*b*) passes through the bending rollers (12*a,b,c*), the cradle roller (17*c*) is further lowered for coil set-down. Uncoiling starts when the cradle rollers (17*b,c*) reverse coil rotation (2*e*) and a peeler (13*h*) forces open the outermost coil wrap (2*h*), so as to feed the new head (1*c*) into a crop shear entry area (19) and towards the finishing mill (18).

Uncoiling may involve passive and/or active coil transfer (2*f*) from the coiling area (12), through the uncoiling and transfer area (13), into the final uncoiling area (13*e*). Active transfer refers to transfer of the coil by applying an external force, either in an upstream direction (100) or a downstream direction (101), and passive transfer refers to transfer of the coil in a downstream direction (101) spontaneously occurring once the pulling and uncoiling forces on the transfer bar (1) can no longer be balanced by the weight of the remaining coil wraps (2*g*). The uncoiling and transfer area (13) may also include means (13*c*) for centering the bar and/or coil about the mill axis, means (13*d*) for re-radiating coil heat, means (13*f*) for restraining the coil during its final stages of uncoiling, and means (13*g*) for ensuring full opening of the coil eye are generally provided. The crop shear entry area (19) generally contains rollers for pinching (19*a,b*) and/or rollers for leveling (19*c*) the bar, and a means (19*d*) for centering the bar about the mill axis. Pinching rollers are generally driven and serve to provide the bar with driving or pulling force while leveling rollers serve idly to reduce transfer bar waves induced by uncoiling (or otherwise); combined arrangements can be suited to pinching, leveling, or both.

Active mandrel-less transfer is initiated from the coiling station into the transfer apparatus by a singly pivoting coil cradle (17*a*) and stationary pusher (18*a*); wherein the singly pivoting coil cradle (17*a*) is constituted by two coil support rollers (17*b,c*) separated by a swing-frame (17*d*), wherein the downstream roller (17*c*) pivots about the axis of the upstream roller (17*b*) and the upstream roller (17*b*) is fixed-to-ground; and wherein a stationary pusher (18*a*) represents generally any means fixed in translation and situated such that when the downstream cradle roller (17*c*) is lowered after coiling, the coil (2*j*) comes into contact with the means below passline (103) whilst remaining in contact with the downstream roller (17*c*) but coming out of contact with the upstream roller (17*b*), and in doing so therefore causes shifting of the coil mass center to a position downstream of the downstream roller (17*c*). In this manner of shifting, the coil weight will become partially and then fully supported by an adjacent coil cradle (16*j*) in FIG. 2, and the coil will leave the coiling station. For a pusher means (18*a*), use of an additional roller will ensure gentle handling of the outside coil surface and is most suitable. For pivoting the swing-frame (17*d*) about the axis of the upstream cradle roller (17*b*), a pivot-on-pivot bearing apparatus will be uniquely employed as per rollers (16*m*) and (16*p*) in FIG. 2. This manner of pivoting about the center of the upstream cradle roller (17*b*) facilitates a compact arrangement whereby adequate movement of roller (17*c*) above and below passline is possible despite the presence of the stationary pusher (18*a*).

The active transfer apparatus of the first embodiment of the invention involves adjacent coil cradles (16*j*) and (16*k*), wherein support roller sets (16*m,n*) and (16*p,q*) are respectively contained and separated by swing-frames (16*r*) and (16*s*). The coil cradles (16*j*) and (16*k*) are unique in that they are singly pivoting; that is, support rollers (16*m*) and (16*p*) are capable of respectively pivoting about the axes of fixed-to-ground rollers (16*n*) and (16*q*). The amount and sequence of tilting of the swing-frames (16*r,s*) will raise or lower the support rollers (16*m,p*) so as to smoothly and forcibly transfer the coil to or from an adjacent coil cradle.

This active transfer apparatus addresses problems of prior art by: maintaining positive forward movement during coil transfer; maintaining continuity of coil support; and using mechanically simple means. Specifically, positive forward movement is ensured because all support rollers are moved to ensure the coil center of mass is always well forward of the upstream support roller when the coil moves into the next pair of support rollers; continuity of coil support is ensured because support rollers are maintained closely adjacent each other; and mechanical simplicity is ensured by using mechanically simple pivots (as opposed to linear slides or otherwise).

Also shown is how the transfer apparatus will be assisted by the mechanism of passive transfer, whereby the combination of uncoiling forces and roller movements act together to transfer the coil. Furthermore, the possibility of passive transfer from the coiling pocket will be allowed at any time during uncoiling since continuity of bar and coil support is maintained.

Figure 3:
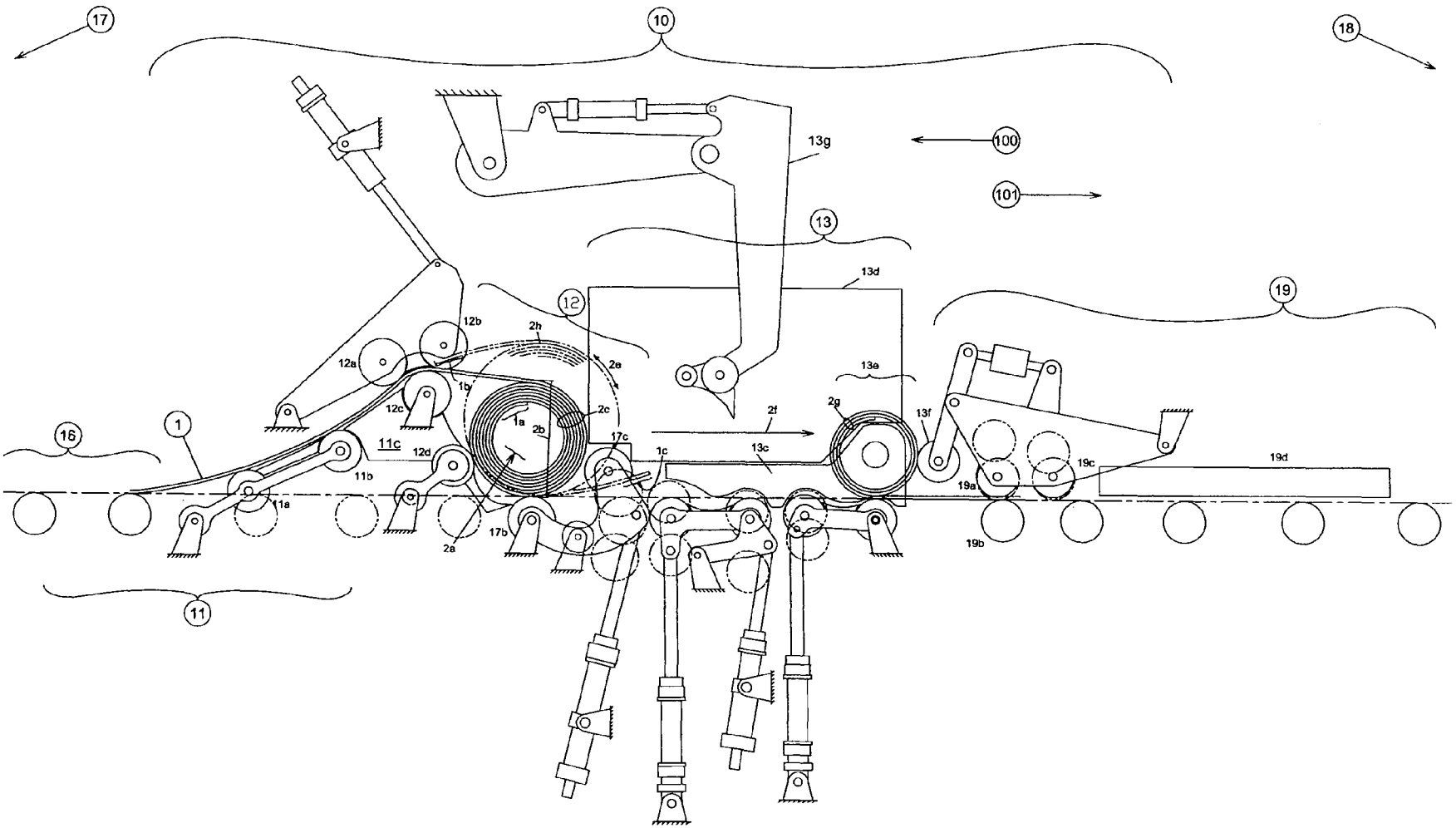
FIG. 3 is a schematic elevation view of a portion of a hot strip mill production line including an active coil transfer apparatus of a coilbox according to a second embodiment.
Figure 4:
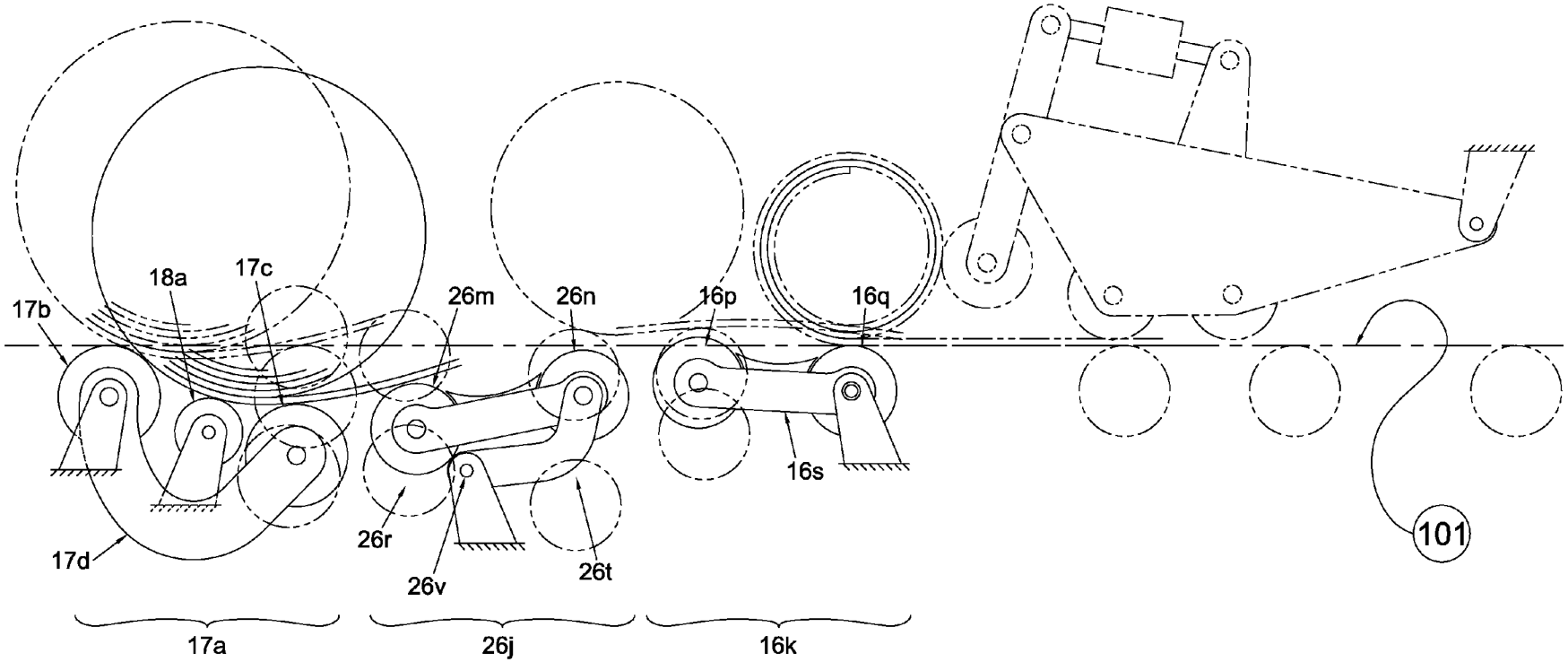
FIG. 4 an enlarged schematic elevation view of the active coil transfer apparatus of the production line of FIG. 3.

Turning to FIGS. 3 and 4, an alternate embodiment of the active transfer apparatus is shown that includes many components in common with the first embodiment. They are given like reference numerals and their description will not be repeated.

The embodiment of FIGS. 3 and 4 combines both singly and dually pivoting coil cradle systems to maximize overall system capabilities and simplicity. In particular, the first coil cradle is dually pivoting and the second is singly pivoting so as to be capable of upstream transfer into the coiling pocket and smooth, controlled downstream transfer into the second coil cradle.

The active transfer apparatus involves an upstream coil cradle (26*j*) and a downstream coil cradle (16*k*). The adjacent coil cradles (26*j*, 16*k*) include respective support roller sets (26*m,n*) and (16*p,q*) which are respectively contained and separated by swing-frames (13*r*) and (16*s*). The upstream coil cradle (26*j*) differs from the downstream coil cradle (16*k*) in that it is dually pivoting; that is, the one support roller (26*m*) is capable of pivoting about the axis of the other roller (26*n*), and the second roller (26*n*) is contained by a second swing-frame (26*t*) which is capable of pivoting about a grounded axis (26*v*). The amount and sequence of tilting of the dually pivoting swing-frames (26*r,t*) will raise or lower the support rollers (26*m,n*) so as to smoothly and forcibly transfer a coil mass center to or from an adjacent coil cradle.

A possible variation of this apparatus involves the use of two or more dually pivoting coil cradles similar to the upstream coil cradle (26*j*) in combination with one or more singly pivoting coil cradles similar to the downstream coil cradle (16*k*). Another variation would combine a dually pivoting coil cradle in a downstream position with a singly pivoting coil cradle in an upstream position.

While the applicant's teachings are described herein in conjunction with various embodiments, it is not intended that the applicant's teachings be limited to such embodiments. On the contrary, the applicant's teachings encompass various alternatives, modifications and equivalents, as will be appreciated by those of skill in the art, the general scope of which is defined in the appended claims.

The invention claimed is:

1. An apparatus for actively transferring a coil of hot metal within a coilbox of a hot strip mill using rollers that each rotate on a rotational axis, comprising:

a first coil cradle assembly that receives the coil of hot metal as it is coiled and as it subsequently starts to uncoil, said first coil cradle assembly having an upstream roller, a swing-frame mounted so as to be able to pivot about the rotational axis of said upstream roller, a downstream roller mounted to said swing-frame with its rotational axis parallel to the rotational axis of said upstream roller, said downstream and upstream rollers being in spaced relationship to receive and support the coil of hot metal with said downstream roller being able to pivot about said upstream roller, and a pusher roller located between said upstream roller and said downstream roller; and a second coil cradle assembly downstream of said first coil cradle assembly, said second coil cradle assembly having a downstream roller, a swing-frame mounted so as to be able to pivot about the rotational axis of said downstream roller, and an upstream roller mounted to said swing-frame with its rotational axis parallel to the rotational axis of said downstream roller, said downstream and upstream rollers being in spaced relationship to receive and support the coil of hot metal, and said upstream roller being able to pivot about said downstream roller so that the coil of hot metal supported by said downstream and upstream rollers can be raised and passed over said downstream roller out of said second coil cradle;

wherein when said downstream roller of said first coil cradle is lowered, the coil of hot metal is placed into contact with said pusher roller, while remaining in contact with said downstream roller of said first coil cradle and coming out of contact with said upstream roller of said first coil cradle, and in doing so causes the coil of hot metal to shift to a position downstream of said downstream roller of said first coil cradle;

and wherein after said downstream roller of said first coil cradle assembly is lowered further, the coil of hot metal is placed into contact with said upstream roller of said second coil cradle;

and wherein when said downstream roller of said first coil cradle assembly is subsequently raised, the coil of hot metal shifts to a position downstream of said upstream roller of said second coil cradle and is placed into contact with said downstream roller of said second coil cradle;

and wherein when said upstream roller of said second coil cradle assembly is subsequently raised, the coil of hot metal passes over said downstream roller of said second coil cradle and shifts to a position downstream of said downstream roller of said downstream roller of said second coil cradle;

and wherein said upstream roller of said first coil cradle assembly has a fixed rotational axis;

and wherein said pusher roller of said first coil cradle assembly has a fixed rotational axis.

2. The apparatus of claim 1, wherein said downstream roller of said second coil cradle assembly has a fixed rotational axis.

3. The apparatus of claim 1, wherein said downstream roller of said second coil cradle assembly has a non-stationary rotational axis.

4. The apparatus of claim 1, 2 or 3 further comprising a third coil cradle assembly having a downstream roller, a swing-frame mounted so as to be able to pivot about the rotational axis of said downstream roller, and a upstream roller mounted to said swing-frame with its rotational axis parallel to the rotational axis of said downstream roller, said first and second rollers being in spaced relationship to receive and support the coil of hot metal, and said upstream roller being able to revolve about said downstream roller so that the coil of hot metal supported by said first and second rollers can be raised and passed over said downstream roller out of said third coil cradle;

wherein when said upstream roller of said second coil cradle assembly is raised and the coil of hot metal passes over said downstream roller of said second coil cradle, the coil of hot metal is placed into contact with said upstream roller of said third coil cradle, while remaining in contact with said downstream roller of said second coil cradle;

and wherein when said upstream roller of said third coil cradle assembly is subsequently raised, the coil of hot metal passes over said downstream roller of said third coil cradle and shifts to a position downstream of said downstream roller of said third roller.

5. The apparatus of claim 4, wherein said downstream roller of said third coil cradle assembly has a fixed rotational axis.

6. The apparatus of claim 4, wherein said downstream roller of said third coil cradle assembly has a non-stationary rotational axis.

* * * * *